US008196444B2

(12) United States Patent
Hohenbichler et al.

(10) Patent No.: US 8,196,444 B2
(45) Date of Patent: Jun. 12, 2012

(54) BENDING DEVICE FOR TWO WORKING ROLLS OF A ROLLING STAND

(75) Inventors: Gerald Hohenbichler, Kronstorf (AT); Armin Schertler, Guntramsdorf (AT); Michael Zahedi, St. Marien (AT)

(73) Assignee: Siemens Vai Metals Technologies GmbH (AT)

( * ) Notice: Subject to any disclaimer, the term of this patent is extended or adjusted under 35 U.S.C. 154(b) by 905 days.

(21) Appl. No.: 12/297,678

(22) PCT Filed: Apr. 2, 2007

(86) PCT No.: PCT/EP2007/002928
§ 371 (c)(1),
(2), (4) Date: Oct. 20, 2008

(87) PCT Pub. No.: WO2007/121832
PCT Pub. Date: Nov. 1, 2007

(65) Prior Publication Data

US 2009/0100891 A1 Apr. 23, 2009

(30) Foreign Application Priority Data

Apr. 21, 2006 (AT) ..... A 682/2006

(51) Int. Cl.
*B21B 29/00* (2006.01)
*B21B 31/32* (2006.01)

(52) U.S. Cl. ..... 72/241.8; 72/245

(58) Field of Classification Search ..... 72/241.2–241.8, 72/245, 246, 237, 465.1, 465.7
See application file for complete search history.

(56) References Cited

U.S. PATENT DOCUMENTS 4,934,166 A 6/1990 Giacomoni
5,195,346 A 3/1993 Braun et al.
5,329,849 A * 7/1994 Roerig ..... 100/162 B
6,112,569 A 9/2000 Ossendorf
(Continued)

FOREIGN PATENT DOCUMENTS

DE 4034436 A1 4/1992
(Continued)

OTHER PUBLICATIONS

International Search Report dated Jun. 22, 2007, issued in corresponding international application PCT/EP2007/002928.

*Primary Examiner* — Debra Sullivan
(74) *Attorney, Agent, or Firm* — Ostrolenk Faber LLP

(57) ABSTRACT

A bending device for two working rolls of a rolling stand. Guide blocks provided in lateral roll housings for guiding two pressure-transmission bodies vertically adjustably with respect to each other and, on which the working rolls are supported via chocks. Bending cylinders are arranged in pairs between the pressure-transmission bodies at each end of the rolls. Each cylinder has a piston rod acting on one pressure-transmission body and a cylinder at the respective other pressure-transmission body. Each pressure-transmission body is supported on a respective guide block in a sliding manner. So that loads acting on the pressure-transmission bodies can be introduced into the guide block free of edge pressure, the pressure-transmission bodies are supported on the respective guide blocks in a sliding manner by self-adjusting wearing plates which include surfaces that enable both sliding and pivoting of the bodies with respect to the guide blocks.

11 Claims, 5 Drawing Sheets

U.S. PATENT DOCUMENTS

| | | | |
|---|---|---|---|
| 6,164,111 | A | 12/2000 | Langeder |
| 2007/0129228 | A1 | 6/2007 | Zieser et al. |

FOREIGN PATENT DOCUMENTS

| | | | |
|---|---|---|---|
| DE | 19536042 | A1 | 4/1997 |
| DE | 19807785 | C1 | 3/1999 |
| DE | 199 38 217 | A1 | 4/2000 |
| DE | 19922373 | A1 | 11/2000 |
| DE | 10123794 | A1 | 1/2002 |
| EP | 0256 408 | A2 | 8/1987 |
| EP | 0233460 | A2 | 8/1987 |
| EP | 0 283 342 | A1 | 9/1988 |
| JP | 01 138010 | A | 5/1989 |
| SU | 1031544 | | 7/1983 |
| SU | 1637892 | | 3/1991 |
| WO | WO 2005/011885 | A1 | 2/2005 |

* cited by examiner

BENDING DEVICE FOR TWO WORKING ROLLS OF A ROLLING STAND

CROSS REFERENCE TO RELATED APPLICATION

The present application is a 35 U.S.C. §§371 national phase conversion of PCT/EP2007/002928, filed 02 Apr. 2007, which claims priority of Austrian Application No. A682/06, filed 21 Apr. 2006 incorporated herein by reference. The PCT International Application was published in the German language.

BACKGROUND OF THE INVENTION

The invention relates to a bending device for two working rolls of a rolling stand having guide blocks provided in lateral roll housings for two vertically adjustable pressure-transmission bodies, on which the working rolls are supported via chocks, and having bending cylinders which are arranged in pairs between the pressure-transmission bodies and having a piston rod acting on one pressure-transmission body and a cylinder formed or held by the respective other pressure-transmission body, the pressure-transmission bodies being supported on the respective guide block in a sliding manner.

Bending devices for axially displaceable working rolls of a rolling stand of this type are already known for example from EP 0 256 408 A2 and DE 199 38 217 A1.

According to EP 0 256 408 A2, chocks receiving the working rolls are supported on a guide projection of pressure-transmission bodies arranged in pairs via a respective sliding surface arranged halfway up. A bending cylinder which acts between the pressure-transmission bodies arranged in pairs can be used to displace the pressure-transmission bodies vertically with respect to one another. In order to vertically guide the pressure-transmission bodies, guide blocks form lateral guide webs which are surrounded by the pressure-transmission bodies. Guide blocks and guide webs are covered in the support regions over their entire area by wearing plates forming sliding surfaces.

A bending device (L-block) for working rolls of a rolling stand is known from DE 199 38 217 A1 that device comprises two pressure-transmission bodies, which are L-shaped in their configuration, and interact in a pair. A bending cylinder acts to generate roll bending forces between the bodies. The pressure-transmission bodies are guided vertically while they are supported in a guide block. The guide block is covered in the regions of contact with the pressure-transmission bodies over its entire area by wearing plates forming sliding surfaces. Loading of the bending cylinders, which are set apart from one another, leads to an eccentric introduction of force into the pressure-transmission bodies. The forces of reaction from the tilting moment result, depending on the tilting direction on opposing wearing plates on the upper and lower wearing plate edge thereof, in locally limited very high pressure. The necessary plate between the guide block and the pressure-transmission bodies forms the basis of this edge effect.

SUMMARY OF THE INVENTION

The invention is thus based on the object of configuring a bending device for the working rolls of a rolling stand of the type described at the outset in such a way that forces of reaction acting transversely to the plane of movement of the pressure-transmission bodies as a result of tilting positions of the pressure-transmission bodies can be diverted into the guide block independently of the edge pressure.

The invention achieves the object set as a result of the fact that the pressure-transmission bodies are supported on the respective guide block in a sliding manner by self-adjusting wearing plates. Thus, the wearing plates rest against the corresponding support surface over their entire area and the production of local edge pressure is entirely avoided as a result of an approximately uniform distribution of loads. This leads to significant lengthening of the service life of the wearing plates, wherein this measure is expected to lengthen the service life threefold. The abutment of the wearing plates over their entire area also eliminates in the edge region of the wearing plates any lubrication problems which are otherwise intensified in the event of non-uniform surface loading and wedge gap formation resulting therefrom as a result of the flowing-away of the lubricant from regions having high surface pressure.

According to an expedient configuration, the self-adjusting wearing plates have a planar sliding surface and a cylindrically or spherically shaped support surface. In this case, the planar sliding surface of the wearing plate rests against a guide surface of the pressure-transmission body in a sliding manner and the cylindrically or spherically shaped support surface of the wearing plate is pivotably supported on a correspondingly configured, cylindrically or spherically configured mating support surface of the guide block.

The extension in terms of area of the sliding surface of the wearing plates is selected in such a way that the maximum occurring surface pressure does not exceed, assuming a uniformly distributed tilting force onto the entire sliding surface, approximately half, preferably one third, of the admissible surface pressure. The higher this arithmetically maximum surface pressure is if the pairing of materials remains unaltered, the shorter the service life to be expected will be.

Constant or intermittent lubrication of the sliding surface and the support surface of the wearing plates is required to ensure the necessary movability of the wearing plates. At least one outlet opening of a lubricant supply line is associated with both the sliding surface and the support surface of each self-adjusting wearing plate, wherein these outlet openings preferably each open into the sliding surface and the support surface. Expediently, the lubricant supply line is guided to the respective wearing plate through the guide block. These lubricant supply lines are advantageously arranged in such a way that at least one respective outlet opening of a common lubricant supply line is associated with the sliding surface and the support surface of the self-adjusting wearing plate, the lubricant supply line penetrating the wearing plate between the support surface and the sliding surface. To ensure uniform distribution of lubricant, lubricant channels are incorporated into the sliding surface and the support surface of the wearing plates.

The spacing of the wearing plates on the vertically arranged leg of the pressure-transmission bodies (lever arm of the tilting forces on the guide block) is selected in such a way that lubricant channels never lie exposed during operation of the bending block.

The preferred embodiment of the wearing plate is equipped with a cylindrical support surface. A radius midpoint on a longitudinal axis of the wearing plate is associated with this cylindrical support surface which in cross section forms an image of an arc of a circle. The mounting, and if necessary additional fastening of the wearing plate, is carried out on a likewise cylindrically configured mating support surface on the guide block. The radius midpoints of the cylindrical support surface of the web plate and of the cylindrical mating support surface of the guide block preferably both lie on a common longitudinal axis, thus allowing (slight) rotational movement about this longitudinal axis. This longitudinal axis preferably lies outside the wearing plate. The longitudinal axis is oriented normally to the axes of rotation of the working rolls. The rotational movement is of an order of magnitude of approximately $1/10°$.

A state of equilibrium, in which the resulting tilting force onto the sliding surface of the wearing plate acts at only a short distance from the center of the sliding surface, is established as a function of friction and lubrication at the cylindrical support surface of the wearing plate, which is supplied with lubricant via a centrally incorporated lubrication pocket, and of the friction and lubrication of the sliding surface of the wearing plate. The smaller the radius of the circle can be selected, the better the self-adjusting effect of the wearing plate will be, although as the radius decreases, the tilting force surface pressure rises.

Spherical supporting of the wearing plate by a spherical cap-shaped support surface is expedient above all when there is a likelihood of tilting movements of the pressure-transmission bodies in a second normal plane or of considerable deformation of the guide block, especially when said deformation reaches an order of magnitude at which slight plastic deformation occurs on circular segment-shaped/cylindrical wearing strips.

In particular for fixing the position of the wearing plates during the assembly of the individual components, it is expedient if the wearing plate is secured in the guide block receiving the mating support surface by a fastening element allowing a pivoting movement of the wearing plate relative to the guide block. This fastening element can be formed by a screw which is sunk in the planar sliding surface of the wearing plate but causes merely loose positioning of the wearing plate and in no way positional fixing thereof.

In the case of a slight tilting position of the pressure-transmission bodies too, constant abutment of all self-adjusting wearing plates against the vertical support surfaces of the pressure-transmission bodies is necessary to ensure optimum lubrication of the wearing plates. For this purpose, between the self-adjusting wearing plate and the guide block supporting the wearing plate, a spreading element resting against or acting on the wearing plate and on the guide block is arranged in a recess. Expediently, this spreading element is formed by a leaf spring which generates a spreading force between the wearing plate and the guide block, so that the contact between the wearing plate and the pressure-transmission body is maintained at all times.

According to a preferred embodiment of the bending device, the pressure-transmission bodies which interact in pairs are L-shaped in their configuration with a longer vertical and a shorter horizontal leg and the legs of the pressure-transmission bodies oppose one another in pairs substantially in a plane parallel to the working rolls. All vertical support surfaces of the pressure-transmission bodies arranged in normal planes vertical to the plane receiving the working rolls are supported exclusively by self-adjusting wearing plates. The horizontal and the vertical leg can also be of the same length.

Further advantages and features of the present invention will emerge from the subsequent description of a non-limiting exemplary embodiment, reference being made to the appended figures in which:

DESCRIPTION OF A PREFERRED EMBODIMENT

Figure 1:
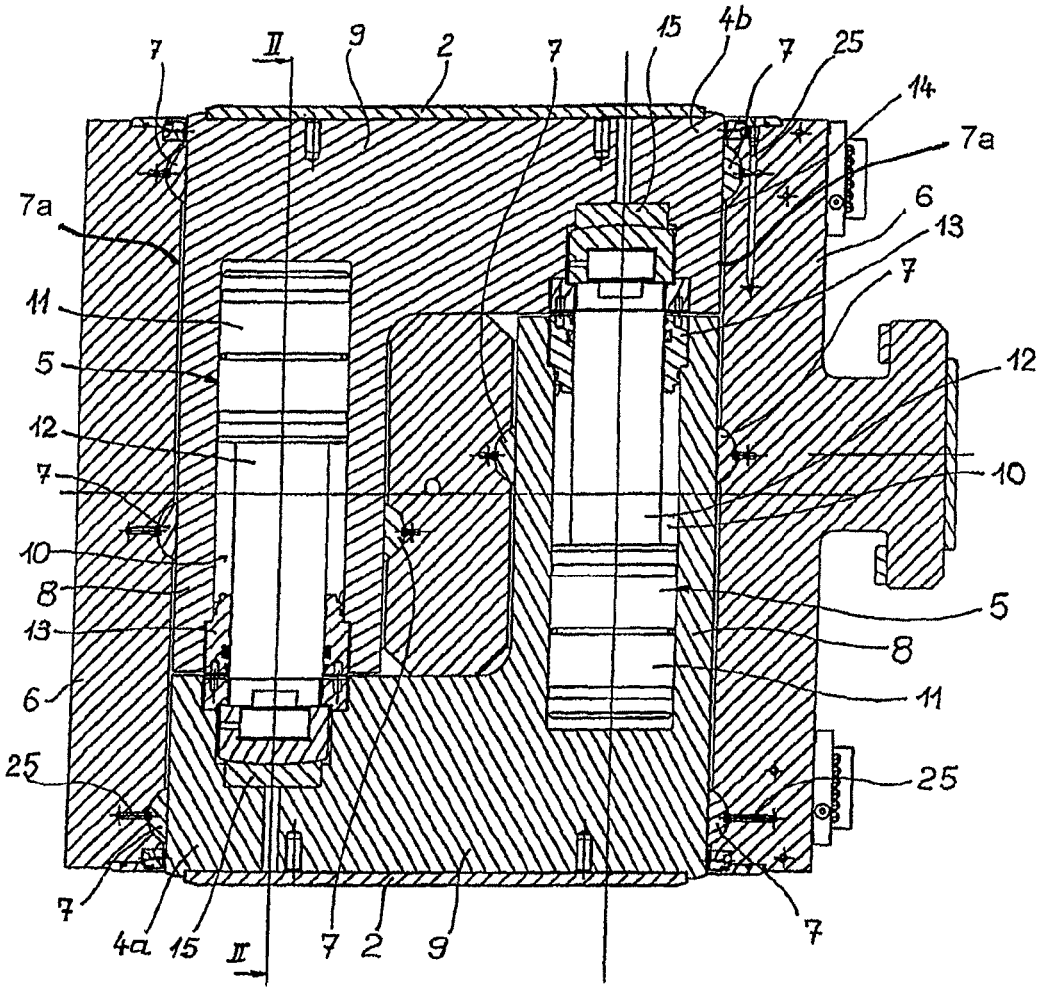
FIG. 1 shows certain details of a first embodiment of a bending device (L-block) according to the invention in a section, parallel to the working rolls, through the pressure-transmission bodies.

Functionally equivalent components are denoted in the embodiments described hereinafter in each case by the same reference numeral.

Figure 2:
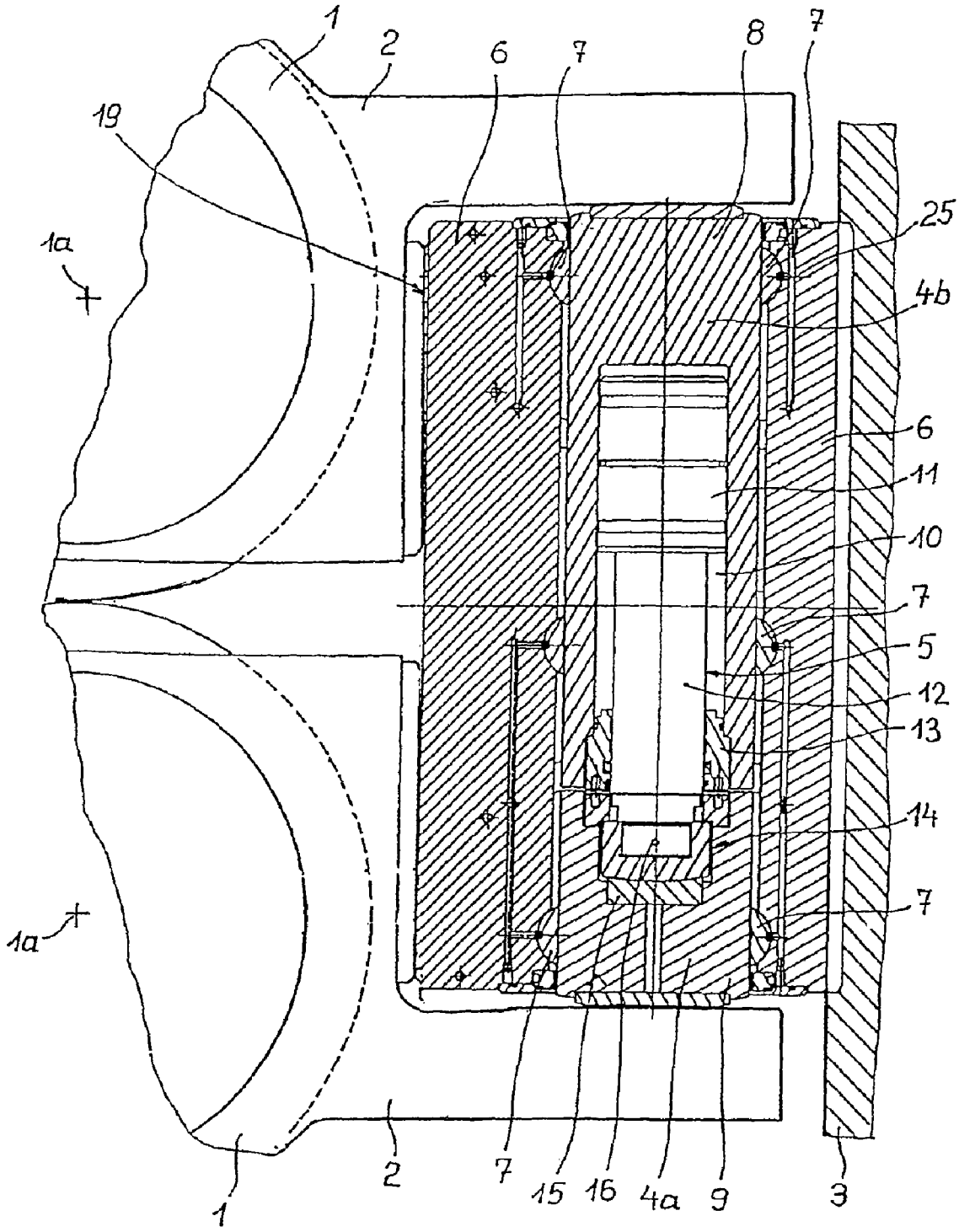
FIG. 2 shows this bending device in a section along the line II-II of FIG. 1.

As illustrated in FIGS. 1 and 2, working rolls 1, which can be driven so as to rotate about axes of rotation 1*a*, of a rolling stand (not shown in greater detail) are mounted at their ends in chocks 2 which can be adjusted vertically in the window of the lateral roll housings 3 in order on the one hand to be able to set a predetermined strip thickness and on the other hand to influence via the vertical adjustment the bending course of the working rolls 1, in particular in relation to axial displacement of the working rolls relative to the support rolls (not shown in the present document). The bending course of the working rolls 1 is influenced with the aid of a bending device consisting substantially of pressure-transmission bodies 4*a*, 4*b* which are arranged in pairs and between which bending cylinders 5 are arranged. The pressure-transmission bodies 4*a*, 4*b*, which are arranged in pairs on both sides of the chocks 2, are mounted in a respective guide block 6 so as to be vertically displaceable on wearing plates 7 which self-adjust in their vertical orientation or on vertical guides 7*a*. As FIG. 2 shows in particular, the guide blocks 6 are laterally fastened in windows of the roll housing 3 and form two parallel vertical guides 7*a* for the pressure-transmission bodies 4*a*, 4*b* which are L-shaped with a longer vertical leg 8 and a shorter horizontal leg 9. The arrangement is in this case made in such a way that the legs 8 and 9 of the pressure-transmission bodies 4*a* and 4*b* oppose one another in pairs, as may be seen in FIG. 1. The legs 8 and 9 of the pressure-transmission bodies 4*a* and 4*b* are provided with a rectangular or square cross section and lie substantially in a common center plane parallel to the working roll plane receiving the axes of rotation 1*a* of the working rolls 1. The cylinders 10 of the bending cylinders 5 can accordingly be formed in a simple manner by the vertical leg 8 of the two pressure-transmission bodies 4*a*, 4*b*. The piston rod 12, which is provided with a piston 11, of the bending cylinders 5 penetrates a cylinder cover 13 and engages with a receiving recess 14 in the horizontal leg 9 of the respective other pressure-transmission body 4*b* or 4*a*. A pressure piece 15 inserted into the receiving recess 14 serves to transmit the bending forces. The piston rod 12 is secured in the receiving recess 14 in a tension-resistant manner by a locking bolt 16 which engages perpendicularly to the piston rod.

The two bending cylinders 5, which are arranged in pairs and associated with the pressure-transmission bodies 4*a* and 4*b*, lie, in a common plane corresponding to the plane of the diagram of FIG. 1, set horizontally apart from each other and generate a tilting moment when they are subjected to pressure in this plane owing to the possible eccentric introduction of bending force, the tilting forces, which act in each pair, being diverted into the guide block 6 and the roll housing 3 via the self-adjusting wearing plates 7. In the plane of the diagram of FIG. 2, there is only very slight non-uniform surface loading on the vertical guides 7*a* as a result of forces of reaction which are diverted onto the guide block 6 via the pressure-transmission bodies 4*a*and 4*b*. Both the vertical guides 7*a*, which are shown in FIG. 2 over their entire area, and the self-adjusting wearing plates 7 shown in FIG. 1 can be used for this purpose. Arranged along the long vertical leg 8 of the pressure-transmission bodies 4*a* and 4*b* are two self-adjusting wearing plates 7 and along the comparatively short horizontal legs 9 of the pressure-transmission bodies is a self-adjusting wearing plate 7.

Figure 3:
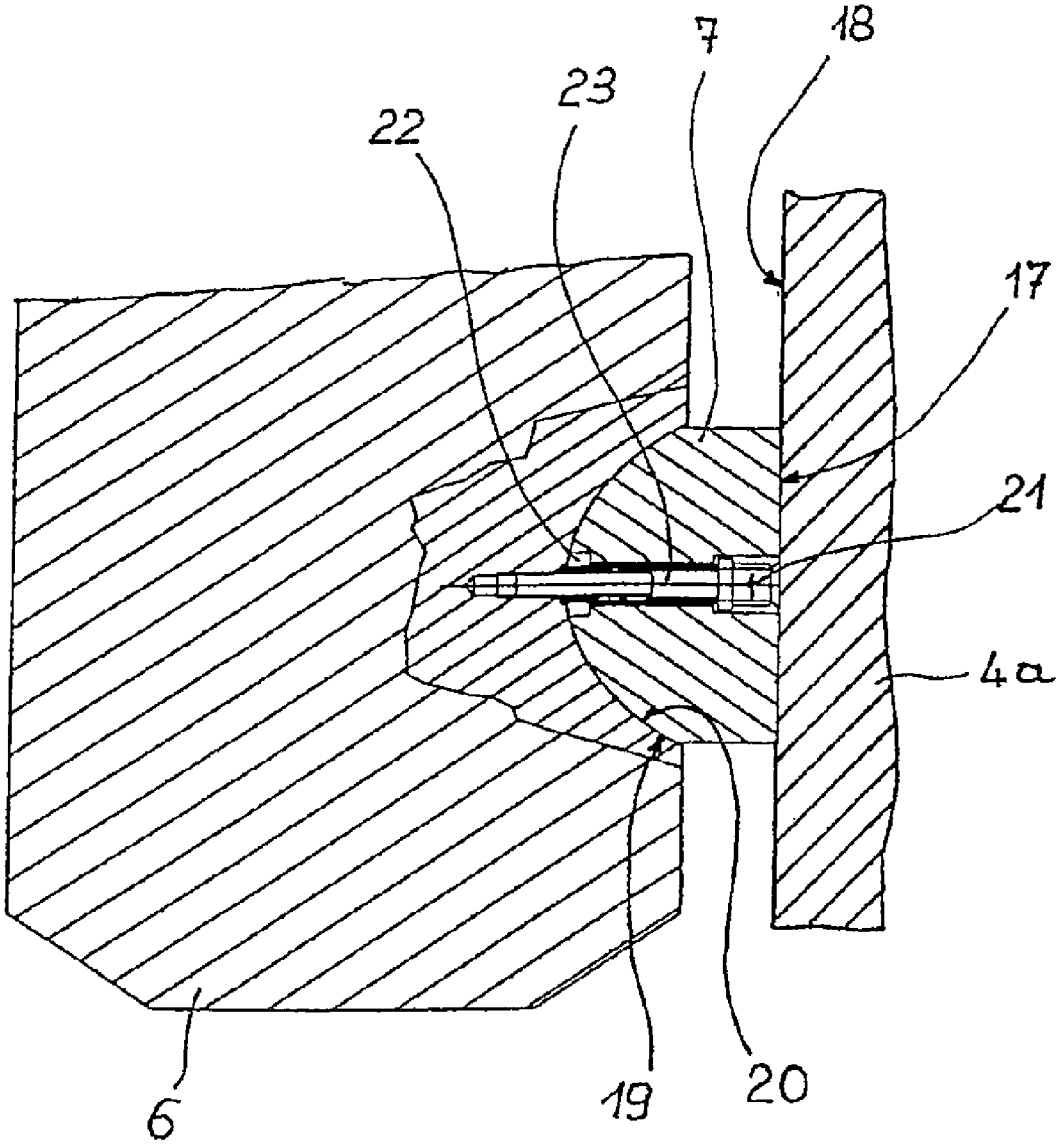
FIG. 3 is an enlarged view of a self-adjusting wearing plate.

FIG. 3 shows the self-adjusting wearing plate 7 which rests flat with a planar sliding surface 17 against a vertical guide surface 18 of the pressure-transmission body 4*a* and is supported with a cylindrically shaped support surface 19 against a mating support surface 20 of the guide block 6 so as to be able to pivot about a radius midpoint 21. The sliding surface 17 of the self-adjusting wearing plate 7 is square or rectangular in its formation and the supporting surface 19 is formed by a portion of a circularly cylindrical lateral surface. A lubrication pocket 22, starting from which sufficient lubrication is ensured for the movement of the adjustment of the wearing plate onto the vertical guide surface 18 of the pressure-transmission body 4*a*, is incorporated into the cylindrically shaped support surface 19 of the wearing plate 7. The wearing plate 7 is fastened to a fastening element 23, which is shown as a screw, without impairing the operationally desired rotational movement on the guide block 6, but easy integration and detachment of the pressure-transmission bodies is allowed.

FIG. 3 also permits in the selected view a further geometrical embodiment of the self-adjusting wearing plate. The wearing plate 7 is equipped with a spherically configured support surface 19 which is part of a sphere surface which is supported on a likewise spherically shaped mating support surface 20 of the guide block 6 so as to be able to pivot about a radius midpoint in two normal directions and thus spatially ensures the planar abutment of the sliding surface of the wearing plate. The planar sliding surface 17 of the self-adjusting wearing plate is in this case preferably circular in its formation.

Figure 4C:
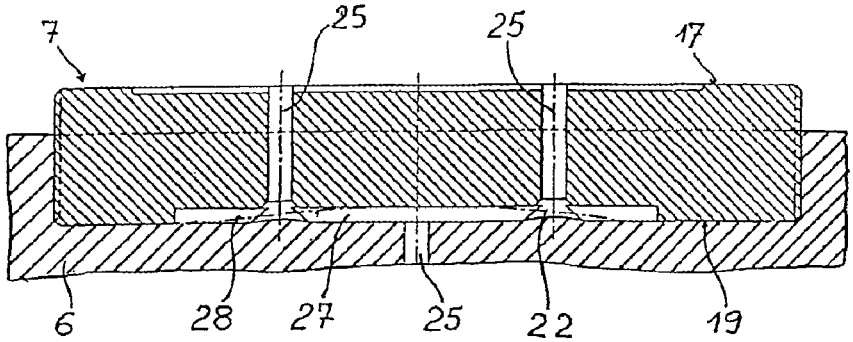
FIG. 4*c* is a cross section through the wearing plate along the sectional line B-B in FIG. 4*a;*
Figure 4B:
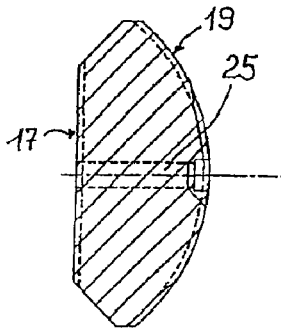
FIG. 4*b* is a cross section through the wearing plate along the sectional line A-A in FIG. 4*a;*
Figure 4A:
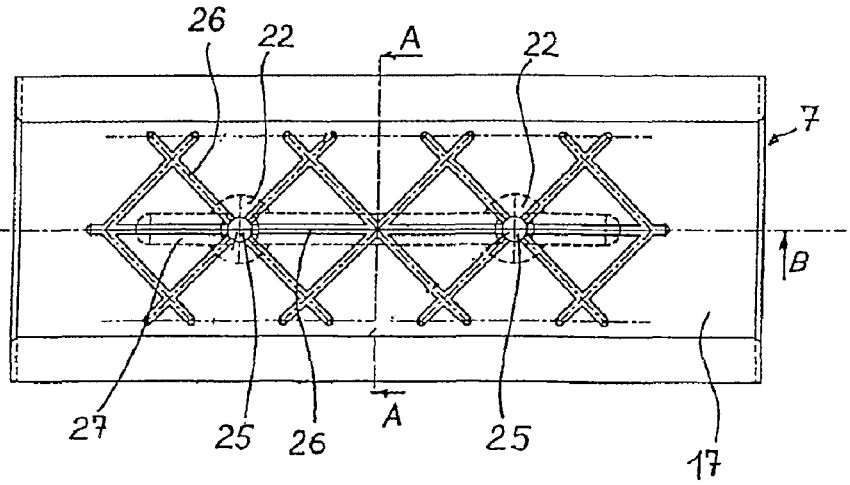
FIG. 4*a* is a plan view onto the planar sliding surface of a wearing plate according to the invention with a possible arrangement of lubricant channels.
Figure 4D:
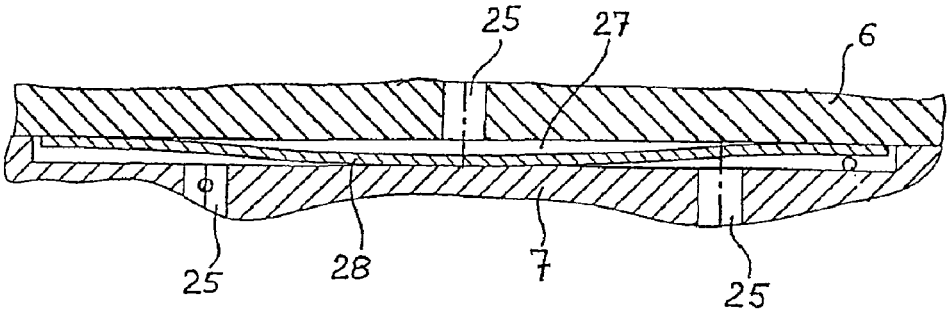
FIG. 4*d* is an enlarged view of the recess for receiving a spreading element on a wearing plate according to FIG. 4*c;*

FIGS. 4*a* to 4*d* show further advantageous designs of the wearing plate, especially for intensive lubrication thereof. Lubricant supply lines 25 are incorporated, as shown in FIGS. 1 and 2, into the guide block 6 in the form of bores and open, starting from a central lubricant supply unit (not shown) or easily accessible lubricating nipple, into the mating support surfaces 20 of the guide blocks 6. These lubricant supply lines 25 subsequently penetrate the wearing plate 7 and connect the cylindrical support surface 19 to the planar sliding surface 17. FIG. 4*a* shows, starting from the outlet openings of two lubricant supply lines 25, lubricant channels 26 which are incorporated into the sliding surface 17, extend over the sliding surface 17 in the manner of lattice-type grids and thus ensure uniform supply of lubricant at the entire sliding surface. At the cylindrically formed support surface 19, the lubricant channels open into conical lubrication pockets 22 which merge with a groove-like recess 27. The recess 27 receives a spreading element 28 which is configured as a leaf spring (FIG. 4*d*), rests on the one hand against the base of the recess 27 and on the other hand against the guide block 6 and generates a spreading force which presses the wearing plate away from the guide block 6 and presses it against the guide surface 18 of the pressure-transmission bodies 4*a*, 4*b*.

Figure 5A:
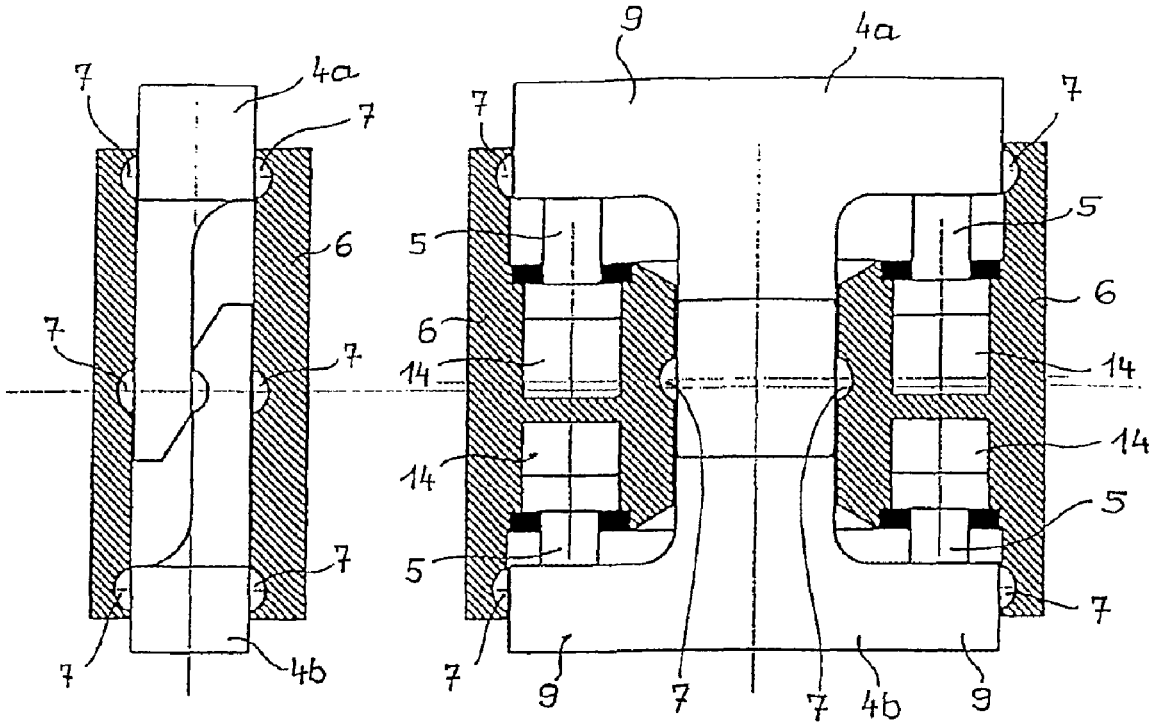
FIG. 5*a* shows a second embodiment of the bending device (T-block) according to the invention in an extended operating position.
Figure 5B:
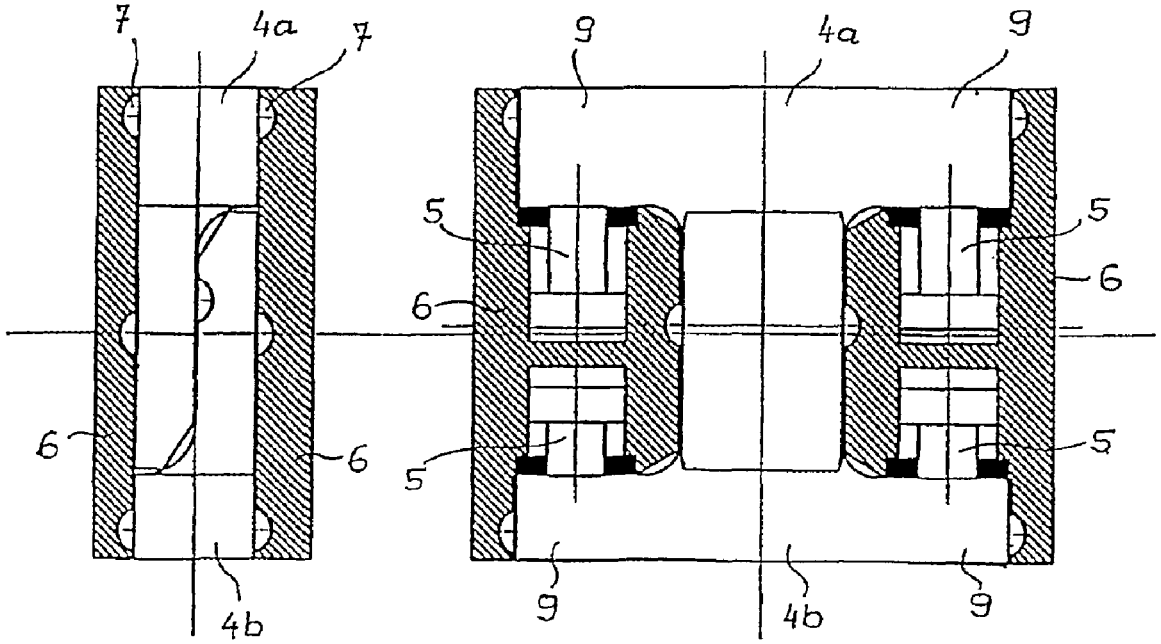
FIG. 5*b* shows the second embodiment of the bending device in a retracted operating position.

A bending means which is known to specialists as a T-block and is equipped with the wearing plates according to the invention is shown in schematic views in FIG. 5*a* in an extended operating position and in FIG. 5*b* in a retracted operating position. These two operating positions are defined by the maximum possible path of vertical displacement of the two pressure-transmission bodies 4*a* and 4*b* which are T-shaped in their configuration. The pressure-transmission bodies 4*a* and 4*b* are guided vertically in a guide block 6, the bending cylinders 5 each acting on the horizontal legs 9 of the pressure-transmission bodies and being embedded in receiving recesses 14 of the guide block 6. The pressure-transmission bodies 4*a* and 4*b* are vertically guided on the guide block 6 by self-adjusting wearing plates 7 which are configured in their design and with regard to the supply of lubricant similarly to the wearing plates according to the views in FIGS. 1 to 4.

The invention is not restricted to the illustrated embodiments. Equally, the self-adjusting wearing plates can for example rest with the sliding surface against a vertical guide surface of the guide block and be supported with the cylindrically spherically shaped support surface in a mating support surface on the pressure-transmission body.

The invention claimed is:

1. In a rolling stand having two working rolls that cooperate to define a passage nip, a bending device having guide blocks in lateral roll housings at ends of the rolls for guiding two pressure-transmission bodies which are vertically adjustable with respect to each other;

chocks supporting the working rolls on both of the bodies;

a pair of bending cylinders at different respective locations along an axis of the rolls and disposed between the pressure-transmission bodies, each cylinder having a piston rod acting on one of the pressure-transmission bodies and a cylinder at the respective other pressure-transmission body; and self-adjusting wearing plates supporting respective ones of the pressure-transmission bodies on the respective guide block at each end of the rolls in a sliding manner;

wherein each self-adjusting wearing plate includes a planar sliding surface toward either the respective pressure-transmission bodies at the end of the working roll or toward the guide block at the end of the working roll, and includes a cylindrically or spherically shaped support surface toward the other of the respective pressure-transmission body or the guide block at the end of the working roll.

2. The bending device as claimed in claim 1, further comprising a lubricant supply line having at least one respective outlet opening associated with the sliding surface and the support surface of the self-adjusting wearing plate.

3. The bending device as claimed in claim 2, wherein the at least one respective outlet opening of the lubricant supply line penetrates the wearing plate at a location between the support surface and the sliding surface.

4. The bending device as claimed in claim 1, wherein the pressure-transmission body has a guide surface against which the planar sliding surface of the wearing plate rests in a sliding manner; and a cylindrically or spherically configured mating support surface of the guide block on which the correspondingly configured cylindrically or spherically shaped support surface of the wearing plate is pivotably supported.

5. The bending device as claimed in claim 1, further comprising a fastening element securing the wearing plate to the guide block for allowing a pivoting movement of the wearing plate relative to the guide block.

6. The bending device as claimed in claim 1, further comprising a spreading element between and acting on the self-adjusting wearing plate and the guide block supporting the wearing plate and the spreading element is arranged in a recess of the wearing plate.

7. The bending device as claimed in claim 1, wherein each pressure-transmission body is L-shaped in configuration including a first vertical leg extending along a direction between the rolls and across the axis of at least one of the rolls and a second horizontal leg extending along a direction of the axis of a respective one of the rolls;

the horizontal legs respectively and the vertical legs respectively of the pressure-transmission bodies oppose one another in respective horizontal and vertical pairs and in a plane parallel to the working rolls; and vertical support surfaces of the pressure-transmission bodies are arranged in normal planes vertical with respect to the plane receiving the working rolls and are supported exclusively by respective ones of the self-adjusting wearing plates.

8. The bending device as claimed in claim 3, wherein the pressure-transmission body has a guide surface against which the planar sliding surface of the wearing plate rests in a sliding manner; and a cylindrically or spherically configured mating support surface of the guide block on which the correspondingly configured cylindrically or spherically shaped support surface of the wearing plate is pivotably supported.

9. The bending device as claimed in claim 3, further comprising a fastening element securing the wearing plate to the guide block for allowing a pivoting movement of the wearing plate relative to the guide block.

10. The bending device as claimed in claim 3, further comprising a spreading element between and acting on the self-adjusting wearing plate and the guide block supporting the wearing plate and the spreading element is arranged in a recess of the wearing plate.

11. The bending device as claimed in claim 4, wherein each pressure-transmission body is L-shaped in configuration including a first vertical leg extending across the axis of at least one of the rolls and a second horizontal leg extending across a direction of the axis of a respective one of the rolls;

the horizontal and vertical legs of the pressure-transmission bodies oppose one another in respective horizontal and vertical pairs and in a plane parallel to the working rolls; and vertical support surfaces of the pressure-transmission bodies are arranged in normal planes vertical with respect to the plane receiving the working rolls and are supported exclusively by respective ones of the self-adjusting wearing plates.

* * * * *